US010518152B2

(12) United States Patent
Branch

(10) Patent No.: US 10,518,152 B2
(45) Date of Patent: Dec. 31, 2019

(54) WEARABLE SHIELD FOR EVALUATING ACCURACY OF A FIGHTER'S PERFORMANCE

(71) Applicant: Donell Tyrone Branch, Colorado Springs, CO (US)

(72) Inventor: Donell Tyrone Branch, Colorado Springs, CO (US)

( * ) Notice: Subject to any disclaimer, the term of this patent is extended or adjusted under 35 U.S.C. 154(b) by 49 days.

(21) Appl. No.: 15/917,278

(22) Filed: Mar. 9, 2018

(65) Prior Publication Data

US 2019/0275397 A1 Sep. 12, 2019

(51) Int. Cl.

| | |
|---|---|
| ***A63B 69/00*** | (2006.01) |
| ***A63B 69/32*** | (2006.01) |
| ***A63B 71/06*** | (2006.01) |
| ***A63B 71/08*** | (2006.01) |

(52) U.S. Cl.

CPC ..... *A63B 69/004* (2013.01); *A63B 69/32* (2013.01); *A63B 71/0622* (2013.01); *A63B 71/08* (2013.01); *A63B 2071/0625* (2013.01); *A63B 2071/0694* (2013.01); *A63B 2220/12* (2013.01); *A63B 2220/40* (2013.01); *A63B 2220/53* (2013.01); *A63B 2220/72* (2013.01); *A63B 2220/75* (2013.01); *A63B 2225/50* (2013.01)

(58) Field of Classification Search

None

See application file for complete search history.

(56) References Cited

U.S. PATENT DOCUMENTS

| | | | | |
|---|---|---|---|---|
| 7,221,552 | B1 * | 5/2007 | Brown | F41H 5/08 361/232 |
| 2014/0248594 | A1 * | 9/2014 | Navas | A61B 5/1124 434/247 |

* cited by examiner

*Primary Examiner* — Ronald Laneau

(74) *Attorney, Agent, or Firm* — Block 45 Legal, LLC

(57) ABSTRACT

A wearable shield for evaluating accuracy of a fighter's performance. The shield has a target strike cover with a front surface and side surfaces. Target aim points are located on the front and side surfaces of the target strike cover for providing aiming points for a user's strikes. Impact absorbers or cushioning are provided so that the user can repeatedly strike the target strike cover safely. A data collection and processing core is attached to the target strike cover. The data collection and processing core has a processor, a data receiving device, a signal transmission device configured to transmit data from the shield, and/or at least one force plate, accelerometer, gyroscope, location sensor, thermometer, pressure sensor, and/or humidity sensor. A flexible strap connected to the rear surface of the target strike cover permits a trainer to wear the shield during workout, training, and practice sessions.

10 Claims, 1 Drawing Sheet

WEARABLE SHIELD FOR EVALUATING ACCURACY OF A FIGHTER'S PERFORMANCE

RELATED PATENT APPLICATION

The present application is related to U.S. Pat. No. 9,789,377, for SHIELD issued to Donell Branch on Oct. 17, 2017 and hereby incorporates the teaching therein by reference.

FIELD OF THE INVENTION

This invention relates to shields and, more particularly, to a wearable shield for evaluating accuracy of a fighter's performance during martial arts, boxing, and other physical contact sports training.

BACKGROUND OF THE INVENTION

For as long as hand-to-hand combat, martial arts, boxing, and related contact sports have been practiced, humans have used equipment to help them train, practice, and develop skills related to those sports. Common and rather ubiquitous examples of such equipment include myriad punching bags. However, most such bags provide only a generally unprecise target for a person to strike. Large hanging bags can be struck using fists, elbows, knees, feet, and various other body parts, in order to practice using one's body to strike. But such bags usually do not provide exact strike aiming points or track the accuracy, force, and precision of strikes. Moreover, such data isn't logged or used to provide post-workout analysis or real-time feedback during the workout/training session. Neither do such bags permit wireless transmission of such data to remote locations.

What is needed is a device that provides a plurality of target aim points that a user can practice striking. The device should be relatively portable so that a trainer can safely hold and manipulate the device in order to help the user train under more real-world conditions. Moreover, the device should be able to gather data concerning the user's performance during the training, workout, or practice session. Such data should include accuracy and precision of strikes, strength or force of strikes, number, speed and/or velocity of strikes, etc.

DESCRIPTION OF RELATED ART

U.S. Pat. No. 9,789,377 issued to the present applicant, Donell Branch, for ACCURACY BALL on Oct. 17, 2017 describes a generally spherical device that has a target strike cover, sensors, grips, and a data core that function in combination to provide a device that a trainer can hold and a fighter can practice striking accurately. The ball has target aim points that a user attempts to strike. The ball can gather data concerning the user's performance during a workout, including strike: accuracy/precision, strength/force, number and velocity, etc. The target strike cover can provide cushioning, as needed. Internal grasp handles allow the accuracy ball to be held safely by providing protection from errant strikes. Sensors, including force plates, accelerometers, gyroscopes, location sensing, temperature, pressure, humidity, etc., can all be incorporated. On/off switch, IO port (such as micro-USB), wireless communication devices, display screen, control switches, etc. can be integrated therein as well. Exported data can be tracked, analyzed, graphed, and used to enhance learning and improve skill sets.

U.S. Published Patent Application No. 2004/0220022 on application by McCreath for TRAINING DEVICE FOR MATERIAL [sic] ARTS on Nov. 4, 2004 describes a training device for a boxing or martial arts practitioner comprises a striking surface which the practitioner and holding means by which a trainer may hold the device, wherein the area of the striking surface is substantially three dimensional.

U.S. Pat. No. 8,708,868 issued to Partlo for FIGHTING ARTS SHIELD LIKE DEVICE on Apr. 29, 2014 describes a fighting arts shield like device designed to be carried or mounted. Through hitting the apparatus the contestant can condition and develop muscles and technique. The device may be either solid or hollow. The shield front is specifically developed to represent striking areas found on a human target and developed such that a properly delivered strike will land solidly; improper or techniques delivered from the wrong distance will not land appropriately. The shield like device may have an optional electrical component that allows measurements to be made of the speed, power and force vectors of strikes where data may be instantaneously presented by audio and visual indicators or disaggregated or used at a later date.

U.S. Pat. No. 9,060,682 issued to Lokshin on Jun. 23, 2016 for DISTRIBUTED SYSTEMS AND METHODS TO MEASURE AND PROCESS SPORT MOTIONS discloses a distributed, multi-stage, intelligent system configured to determine user action performance characteristics parameters in action sports. The system includes stage-one, wearable devices configured to use sensors to collect initial data and transfer the initial data to stage-two devices which may temporally store the initial data and/or perform further data processing to generate intermediate data for communication to one or more stage-three devices configured for long term data storage, further processing and presentation.

U.S. Pat. No. 9,610,476 issued to Tran, et al. on Apr. 4, 2017 for SMART SPORT DEVICE, one of a number of patents issued to the same inventors, discloses a glove that includes a light source; sensors including a camera and a microphone array; a processor coupled to the light source and the sensor; and a wireless transceiver coupled to the processor.

U.S. Pat. No. 9,616,310 issued to Manley for HARNESS FOR MARTIAL ARTS TRAINING, PROFESSIONAL MIXED MARTIAL ARTS AND BOXING TRAINING, COMBAT TRAINING, FITNESS TRAINING, AND STRIKING TRAINING AND PRACTICE on Apr. 11, 2017 describes a device to be worn or otherwise attached to a first person (wearer) so that a second person (training athlete) can strike the device to simulate movements in an athletic competition, combat training or to allow fitness movements. A central pad is mounted to the wearer using a series of straps or other structures, and preferably two handles are mounted to the lateral sides of the central pad. The wearer holds the handles while the training athlete punches, kicks, knees, elbows, or forearms the central pad. The wearer can move the central pad using the handles, or can brace himself or herself with the handles, or both.

U.S. Pat. Nos. 9,830,951, 9,619,891, 9,607,652, and 9,406,336, all issued to Bose, et al., the '951 patent being issued on Nov. 28, 2017 for MULTI-SENSOR EVENT DETECTION AND TAGGING SYSTEM discloses a sensor event detection and tagging system that analyzes data from multiple sensors to detect an event and to automatically select or generate tags for the event. Sensors may include for example a motion capture sensor and one or more additional sensors that measure values such as temperature, humidity, wind or elevation. Tags and event detection may be performed by a microprocessor associated with or integrated with the sensors, or by a computer that receives data from the microprocessor. Tags may represent for example activity types, players, performance levels, or scoring results. The system may analyze social media postings to confirm or augment event tags. Users may filter and analyze saved events based on the assigned tags. The system may create highlight and fail reels filtered by metrics and by tags.

SUMMARY OF THE INVENTION

In accordance with the present invention, there is provided a wearable shield for evaluating accuracy of a fighter's performance. The shield has a target strike cover with a front surface and side surfaces. Target aim points are located on the front and side surfaces of the target strike cover for providing aiming points for a user's strikes so that a user can focus in on precise aiming of his or her strikes. Impact absorbers or cushioning are provided so that the user can repeatedly strike the target strike cover safely. A data collection and processing core is attached to the front surface of the target strike cover. The data collection and processing core has a processor, a data receiving device, a signal transmission device configured to transmit data from the shield, and/or at least one force plate, accelerometer, gyroscope, location sensor, thermometer, pressure sensor, and/or humidity sensor. A flexible strap connected to the rear surface of the target strike cover permits a trainer to wear the shield during workout, training, and practice sessions.

Trainer is defined herein to include the traditional sports trainer as well as any other training helper, be it a person, machine, or device.

It is therefore an object of the invention to provide a shield that can be held or, preferably, worn by a trainer for evaluating accuracy of a martial arts or boxer fighter's performance.

It is a further object of the present invention to provide a shield that records a martial arts or boxer fighter's accuracy/precision, strength/force, direction, number or strikes, and velocity thereof.

It is a further object of the present invention to provide a shield that wirelessly transmits a record of a martial arts practitioner or a boxer's strikes to a remote location.

It is a further object of the present invention to provide a shield that incorporates force plates, accelerometers, gyroscopes, location, temperature, pressure, and humidity sensors therein.

These and other objects and advantages of the present invention are more readily apparent with reference to the following detailed description and the accompanying drawings.

BRIEF DESCRIPTION OF THE DRAWINGS

A complete understanding of the present invention may be obtained by reference to the accompanying drawings, when considered in conjunction with the subsequent detailed description, in which.

Like reference numerals refer to like parts throughout the several views of the drawings.

DETAILED DESCRIPTION OF THE PREFERRED EMBODIMENT

Although the following detailed description contains specific details for the purposes of illustration, those of ordinary skill in the art will appreciate that variations and alterations to the following details are within the scope of the invention. Accordingly, the exemplary embodiments of the invention described below are set forth without any loss of generality to, and without imposing limitations upon, the claimed invention.

The invention is a wearable shield for evaluating accuracy of a fighter's performance. The shield has a target strike cover with a front surface and side surfaces. Target aim points are located on the front and side surfaces of the target strike cover for providing aiming points for a user's strikes so that a user can focus in on precise aiming of his or her strikes. A data collection and processing core is attached to the either the front surface or the rear of the target strike cover. The data collection and processing core has a processor, a data receiving device, a signal transmission device configured to transmit data from the shield, and various sensors.

Figure 1:
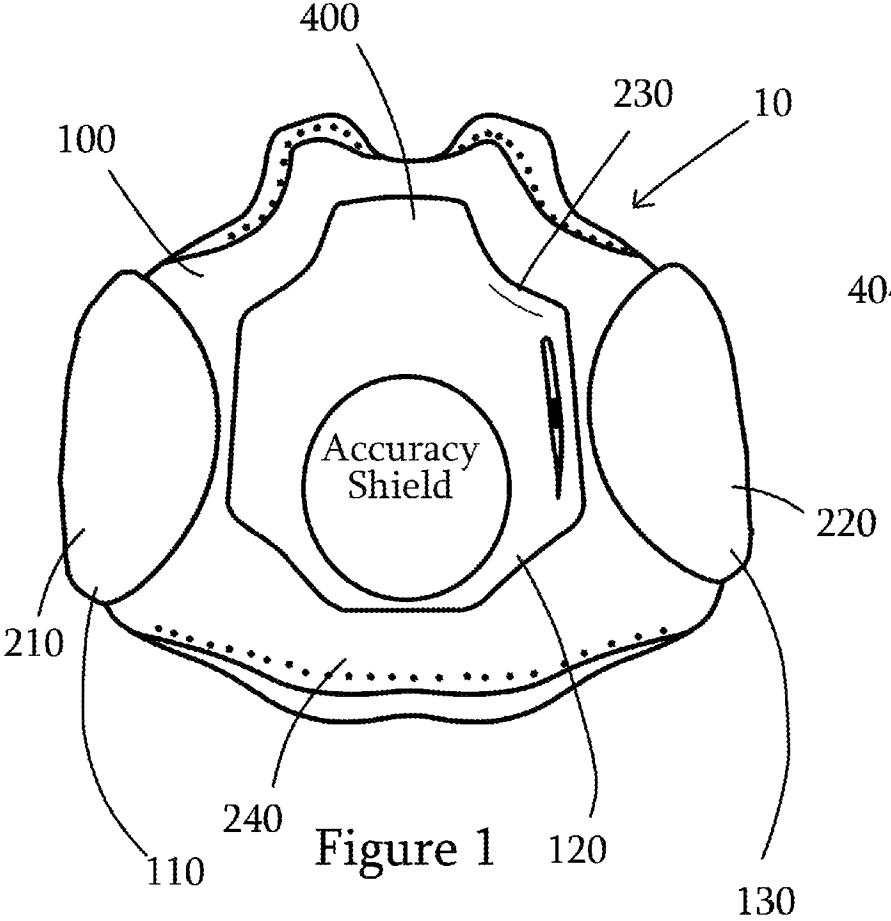
FIG. 1 illustrates a front view of an exemplary embodiment of a shield in accordance with the present invention.

Referring now to the drawings, FIG. 1 illustrates a front view of an exemplary embodiment of the inventive shield 10. In the embodiment illustrated in FIG. 1, the front of shield 10 is generally planar having an outer component comprising a target strike cover 100. In other embodiments, additional coverings may be added over target strike cover 100 such that target strike cover 100 is no longer the most outer component, although it can still be considered an outer component.

Target strike cover 100 functions to provide specific target aim points for a user's strikes as well as providing cushioning and/or impact absorption. In some embodiments, especially if the user is utilizing gloves or pads, less impact absorption is generally needed and target strike cover 100 can provide little to no cushioning. In other embodiments, especially if the user is not utilizing any protective gear, more impact absorption is useful and target strike cover 100 can provide additional cushioning.

Target strike cover 100 indicates specific target aim points. In the embodiment in FIG. 1, target aim points 110, 120, and 130 are illustrated. Any useful target aim point shapes/designs can be utilized without departing from the scope of the invention.

No sensors or electronics are obviously visible in the embodiment shown in FIG. 1. A data collection and processing core 400 comprises a covered printed circuit board 402 with a light button or switch 404, such as a SPST tactile switch manufactured by Dailywell Electronics Co. Ltd. as Part No. KT-002GQ-A13 or manufactured by Omron Electronics as Part No. B3 W-9000-RG2C, and components affixed thereto. In the preferred embodiment, printed circuit board 402 is affixed to the front surface of shield 10, but board 402 alternatively can be affixed to the rear surface of shield 10 or any other convenient location thereon. To render data collection and processing core 400 of shield 10 operational, a trainer, not shown, presses light button 404, which first blinks a yellow color and then blinks red. When shield 10 is operational, light button 404 turns solid green.

Printed circuit board 402 can incorporate a plethora of electronics and sensors, including force plates, accelerometers, such as Part No. H3LIS331DLTR manufactured by the Swiss company, STMicroelectronics, gyroscopes, location sensors (e.g., GPS devices), thermometers and thermistors, such as Part No. FT003-104F439FLO0105 manufactured by Hitano Enterprise Corp., and bead thermistors, such as Part No. NTCLE203E3104FB0 manufactured by Vishay BC Components, pressure sensors (e.g., piezoelectric transducers and devices), humidity sensors and signal transmitters. User input/outputs can also be included, such as an on/off switch, I/O (e.g., micro-USB) port, wireless communication devices, display screen, control switches, and the like. Such devices can be voice-activated, manual, or remotely operated. Additional robust sensors can be located throughout shield 10 so as to consistently report any and all data gathered thereby. For example, a plurality of impact sensor plates 210, 220, 230, and 240 can be incorporated in shield. Such impact sensor plates can sense the location, force, speed, force and/or direction of impacts.

Data collection and processing core 400 is attached to a substrate of shield 10. Core 400 has at least a processor, such as Part No. LTC2954CTS8-2#TRMPBF manufactured by Linear Technology, Inc., a data receiving device and a data transmission device. A plurality of force plates, pressure sensors, and accelerometers is configured to gather data concerning any strikes sustained by shield 10. The plurality of sensors are in electronic communication with data receiving device, so that any data sensed can be sent to and gathered by data receiving device. An additional data receiving device can be located at a remote location for receiving signals wirelessly transmitted thereto by data transmission device.

Processor can be configured to process data from data collection device, processor being in electronic communication with data transmission device, to communicate raw data gathered from sensors, processed data, or both. Data transmission device is configured to transmit data from shield 10. Examples of data transmission device include a wireless transmitter, micro-USB port, and external memory card port. Such data can be tracked, analyzed, graphed, and used to enhance learning, improve skill sets, compare and/or contrast users, workouts, or training sessions.

Data collection and processing core 400 can also contain or control visual indicators and/or audio production devices. For example, shield 10 can emit light whenever core 400 determines that pre-determined conditions have been met. Various levels, colors, and locations of light emissions can be integrated into shield 10. For example, when a user strikes shield 10 within a certain distance from one of the target aim points 110, 120, 130, one or more lights and/or sounds can be emitted from shield 10. Sounds can also include verbal commands to strike various target aim points, increase or decrease striking force or speed, and provide feedback as to the effectiveness of strikes.

Figure 2:
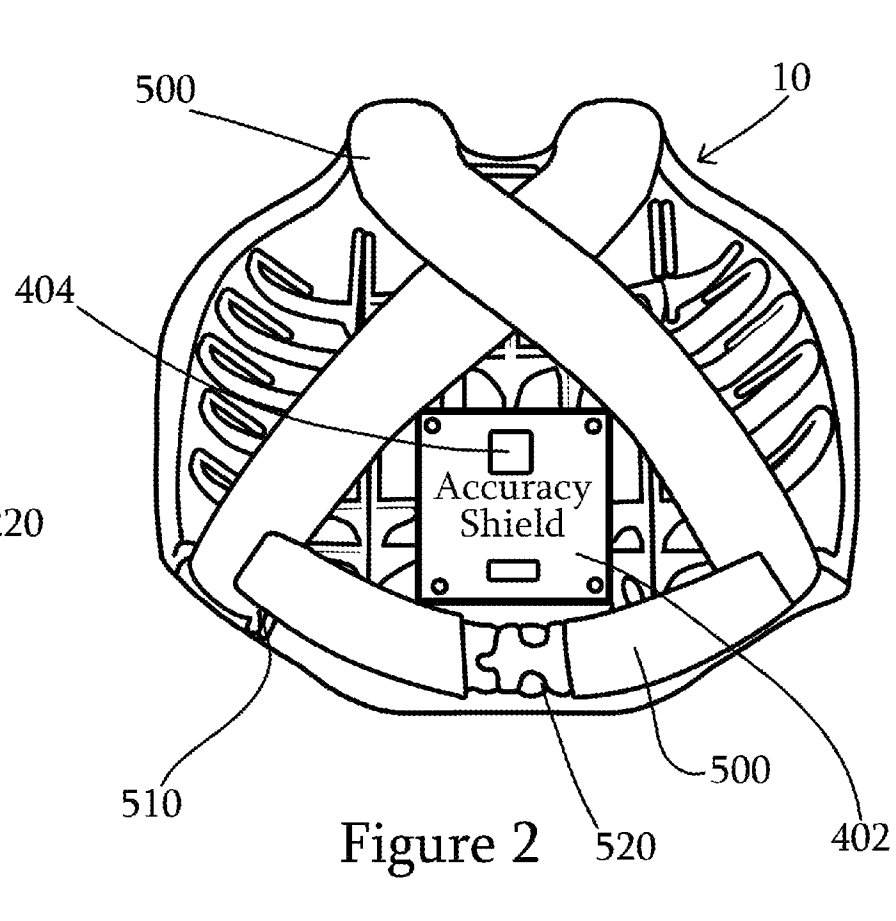
FIG. 2 illustrates a rear view of an exemplary embodiment of the shield shown in FIG. 1.

FIG. 2 illustrates a rear view of shield 10. Attached to the rear surface at perimeter extremities of shield 10 or covering thereof are flexible crossing straps 500 that are threaded through loops 510 affixed to shield 10 and retained by a seatbelt fastener 520 well known to those skilled in the field. In operation, a trainer, not shown, positions himself or herself proximate rear surface of shield 10 and uses straps 500 and buckle 520 to strap in, shield 10 protecting the trainer from strikes of the martial arts practitioner or boxer.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A substantially planar, wearable shield for evaluating accuracy of a fighter's performance, said shield comprising:

a) a target strike cover having a front surface, a rear surface, and side surfaces, said target strike cover comprising an impact-absorbing cushion for providing impact absorption so that the user can repeatedly strike said target strike cover safely;

b) a plurality of target aim points disposed on at least one of said surfaces of said target strike cover for providing aiming points for a user's strikes, each of said target aim points comprising at least one sensor selected from a group of sensors consisting of: force plates, accelerometers, gyroscopes, location sensors, thermometers, thermistors, bead thermistors, pressure sensors, and humidity sensors;

c) a data collection and processing core affixed to said target strike cover for gathering data from said at least one sensor disposed on a surface of said target strike cover; and d) at least one flexible strap affixed to said rear surface of said target strike cover for facilitating wearing of said shield by a trainer during workout, training, and practice sessions.

2. The substantially planar, wearable shield for evaluating accuracy of a fighter's performance in accordance with claim 1, wherein said at least one sensor is in electronic communication with a data receiving device.

3. The substantially planar, wearable shield for evaluating accuracy of a fighter's performance in accordance with claim 1, wherein said processor is configured to process data received from said data receiving device, said processor being in electronic communication with said data receiving device and said signal transmission device.

4. The substantially planar, wearable shield for evaluating accuracy of a fighter's performance in accordance with claim 1, further comprising a buckle operatively connected to said strap for the tightening thereof around a trainer.

5. The substantially planar, wearable shield for evaluating accuracy of a fighter's performance in accordance with claim 1, further comprising a switch configured to turn on data collection and processing functions of said shield.

6. A substantially planar, wearable shield for evaluating accuracy of a fighter's performance, said shield comprising:

a) a target strike cover having a front surface, a rear surface, and at least one side surface, said target strike cover comprising an impact-absorbing cushion for providing impact absorption so that the user can repeatedly strike said target strike cover safely;

b) at least one target aim point disposed on at least one surface of the target strike cover, said target aim point comprising at least one sensor selected from a group of sensors consisting of: force plates, accelerometers, gyroscopes, location sensors, thermometers, thermistors, bead thermistors, pressure sensors, and humidity sensors;

c) a data collection and processing core affixed to said target strike cover for gathering data from said at least one sensor disposed on a surface of said target strike cover; and d) at least one flexible strap affixed to said rear surface of said target strike cover for facilitating wearing of said shield by a trainer during workout, training, and practice sessions.

7. The substantially planar, wearable shield for evaluating accuracy of a fighter's performance in accordance with claim 6, wherein said at least one sensor is in electronic communication with a data receiving device.

8. The substantially planar, wearable shield for evaluating accuracy of a fighter's performance in accordance with claim 6, wherein said processor is configured to process data received from said data receiving device, said processor being in electronic communication with said data receiving device and said signal transmission device.

9. The substantially planar, wearable shield for evaluating accuracy of a fighter's performance in accordance with claim 6, further comprising a buckle operatively connected to said strap for the tightening thereof around a trainer.

10. The substantially planar, wearable shield for evaluating accuracy of a fighter's performance in accordance with claim 6, further comprising a switch configured to turn on data collection and processing functions of said shield.

* * * * *